United States Patent [19]

Hovorka

[11] 4,292,507

[45] Sep. 29, 1981

[54] FOOTBALL STATISTIC PEGBOARD

[76] Inventor: J. Warren Hovorka, 10102 Verde Lomas Dr., Villa Park, Calif. 92667

[21] Appl. No.: 884,762

[22] Filed: Mar. 9, 1978

Related U.S. Application Data

[63] Continuation-in-part of Ser. No. 736,368, Oct. 28, 1976, abandoned.

[51] Int. Cl.[3] ..... A63F 1/18

[52] U.S. Cl. ..... 235/90

[58] Field of Search ..... 235/70 A, 90, 69, 89 R, 235/78 G, 88 G; 116/120, 136, 135; 273/134 CF, 148 R

[56] References Cited

U.S. PATENT DOCUMENTS

| | | | |
|---|---|---|---|
| 402,700 | 5/1889 | Van Lile | 116/120 |
| 788,779 | 5/1905 | Lang | 235/90 |
| 1,145,211 | 7/1915 | Pine | 235/90 |
| 2,520,668 | 8/1950 | Wheeler | 116/120 |
| 3,853,264 | 12/1974 | Hovorka | 235/70 A |
| 4,003,580 | 1/1977 | Haffey, Jr. | 273/134 CF |
| 4,019,737 | 4/1977 | Witzel | 273/134 CF |
| 4,108,356 | 8/1978 | Bengtson | 235/89 R |

*Primary Examiner*—L. T. Hix
*Assistant Examiner*—Benjamin R. Fuller
*Attorney, Agent, or Firm*—Fischer, Tachner, & Strauss

[57] ABSTRACT

There is disclosed a calculating and recording device of the slide rule type for determining and retaining play statistics of a football game. The device has a body bearing at least one, and preferably two, coextensive grooves, each of which can receive a slide which is calibrated in indicia of arithmetic progression coextensive with the length of the slide. The rule includes removable marker means each bearing an indicium of a single class of a plurality of distinct classes of indicia representing plays or types of plays of a football game and the body of the rule has at least three parallel rows of receiver means in arithmetic spacing equal to the spacing of the indicia of the slide which receive the removable marker means to record passing, rushing and first down statistical information. In the preferred embodiment, the marker means comprise a plurality of varied color, shape or size of pegs and/or cooperative rings, each of which represents a certain type of passing, rushing or kicking play, first down or other statistic, and the like and the rule is provided with sufficient receiver means to record substantially all of the plays made by a team in a single quarter or half of the football game. The preferred embodiment also employs receiver means for locating removable marker means in the groove which receives the slide, thereby permitting markers to be placed indicating how each drive ends and providing a reference stop for the slide and permitting its use for indicating the number of plays in the present drive. The marker means also permits identification of each play in a series of plays such as first, second third or fourth down play.

25 Claims, 5 Drawing Figures

Game Date | Home Team | Visitor Team

Player's Team In 1ST HALF — Team Name

Player's Name

AUTO-STAT FOOTBALL SCORECARD

Player's Team In 2ND HALF — Team Name

| PRED | ACT | DIFF | TOTAL DIFF | | | STATISTICS | ROW | PEGS & RING | PRED | ACT | DIFF | TOTAL DIFF |
|---|---|---|---|---|---|---|---|---|---|---|---|---|
| | | | | RUSH | 1 | RUN | A | Blue | | | | |
| | | | | | 2 | QB SCRAMBLE | A | Green | | | | |
| | | | | | 3 | QB SACK | A | Red | | | | |
| | | | | PASS | 4 | INTERCEPTION | B | Blue | | | | |
| | | | | | 5 | COMPLETE | B | Green | | | | |
| | | | | | 6 | INCOMPLETE | B | Red | | | | |
| | | | | 1ST DN | 7 | BY RUSH | C | Blue | | | | |
| | | | | | 8 | BY PASS | C | Green | | | | |
| | | | | | 9 | BY PENALTY | C | Red | | | | |
| | | | | CONVER | 10 | 3RD DN MISS | C | Gold | | | | |
| | | | | | 11 | 3RD DN MADE | C | Ring on B, G, or R | | | | |
| | | | | | 12 | 4TH DN MISS | A/B | Gold | | | | |
| | | | | | 13 | 4TH DN MADE | C | Ring on B, G, or R | | | | |
| | | | | DRIVE END | 14 | F-GOAL MISS | D | Gold | | | | |
| | | | | | 15 | F-GOAL MADE | D | White | | | | |
| | | | | | 16 | PUNT | D | B, G, or R | | | | |
| | | | | | 17 | OPP PUNT R-B | E | G, or R | | | | |
| | | | | | 18 | EX. PT. MISS | E | B, R, or GO | | | | |
| | | | | | 19 | EX. PT. MADE | E | Ring on B, or R (W) | | | | |
| | | | | OTHER | 20 | PENALTY | A | Total | | | | |
| | | | | | 21 | FUMBLE LOST | B | B, R, or W | | | | |
| | | | | | 22 | FUMBLE RECOV. | B | Green | | | | |
| | | | | | 23 | KICK-OFF | D | Total | | | | |
| | | | | | 24 | OPP K-O R-B | E | G, or R | | | | |
| | | | | MISC | 25 | TEAM SCORE | | | | | | |
| | | | | | 26 | | | | | | | |
| | | | | | 27 | | | | | | | |
| | | | | | 28 | | | | | | | |
| | | | | | | TOTAL DIFF IN EACH HALF | | | | | | |

Note: PRED - Player's PREDiction Before Each Half
ACT - ACTual Statistic on Auto-Stat Pegboard
DIFF - DIFFerence Between PREDiction & ACTual

TOTAL DIFF IN GAME

FIGURE 2

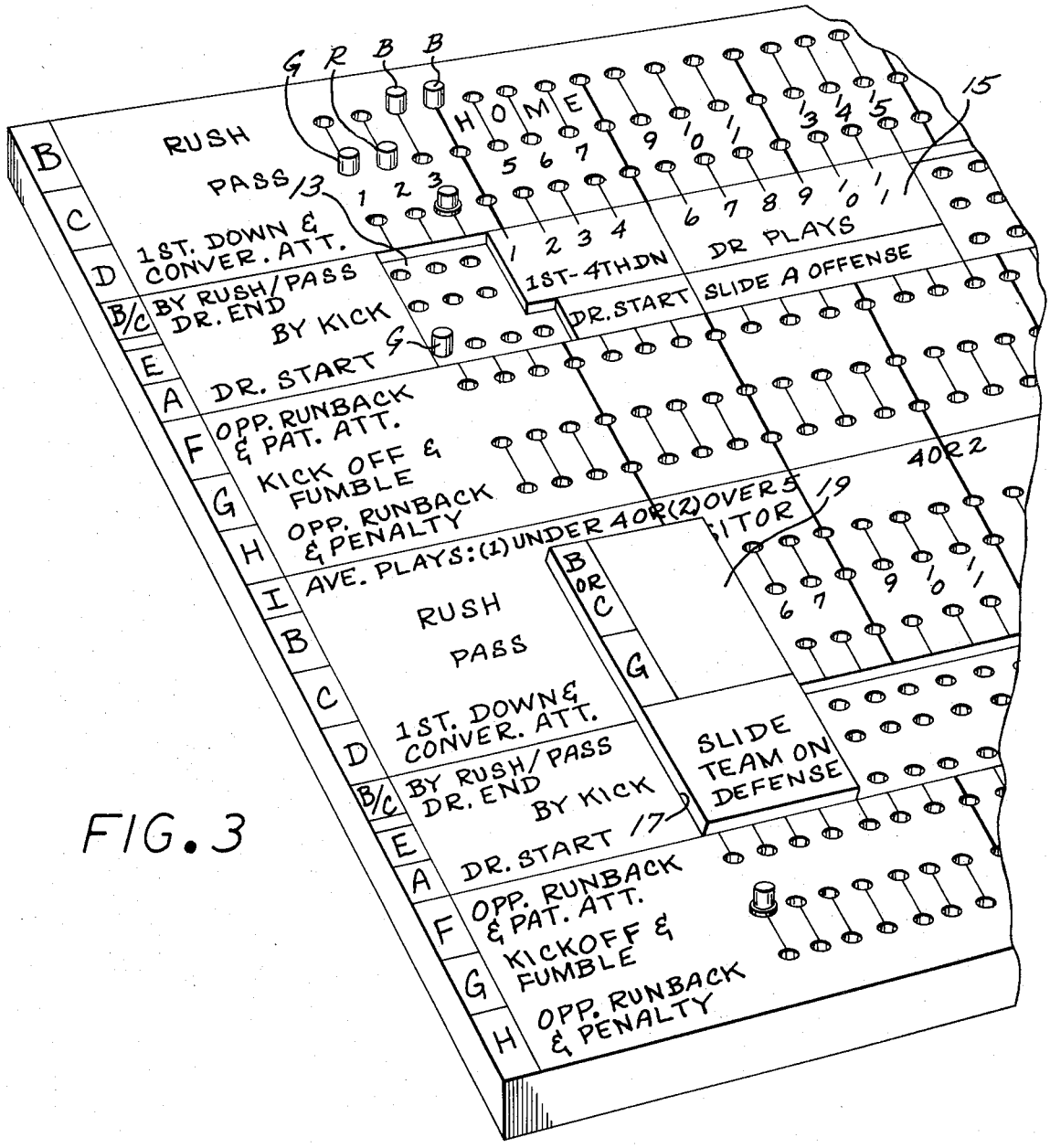
FIG. 3
FIG. 4
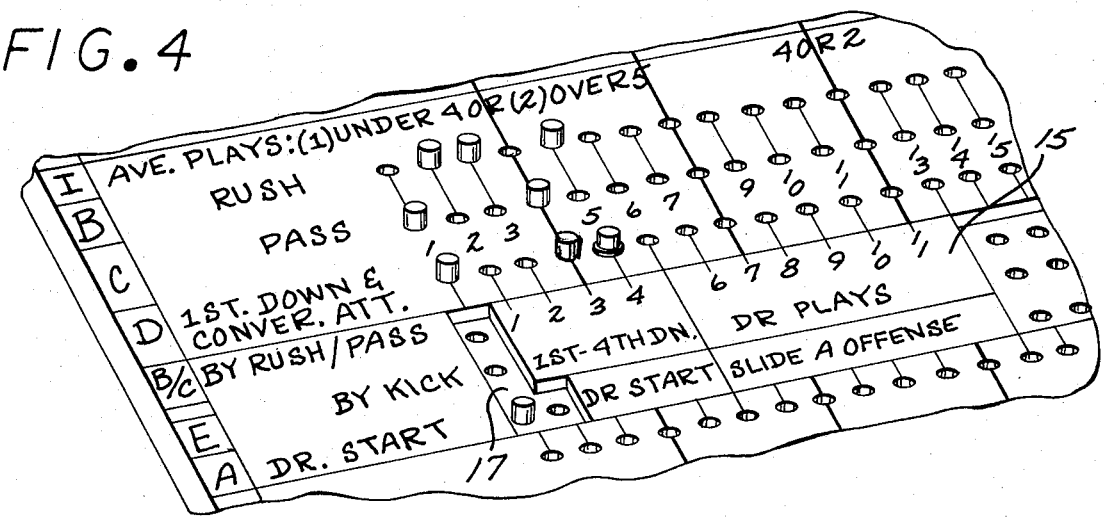

FOOTBALL STATISTIC PEGBOARD

This application is a continuation-in-part of my patent application, Ser. No. 736,368, filed Oct. 28, 1976, now abandoned.

BACKGROUND OF THE INVENTION

1. Field of Invention

This invention relates to a statistics recording and calculating device and, in particular, to a device for calculating and recording the play statistics of a football game.

2. Brief Statement of the Prior Art

Some prior attempts have been made to aid the task of keeping statistics of a football game, however, these attempts have not been totally successful. A game indicator is described in U.S. Pat. No. 546,959 to record the down and field position. An attempt was made to measure yardage with a slide rule device in U.S. Pat. No. 1,736,603. A prior patent of mine, U.S. Pat. No. 3,853,264, discloses and claims an effective device for calculating and recording the yardage statistics of a football game.

Statisticians, coaches, reporters, as well as fans listening to the game on radio or watching it on television often desire an accurate and instantaneous indication of the play statistics that have transpired of such statistics which are desired are those which relate to: (1) number and type of rushing plays; (2) number and types of passing plays; (3) number and type of first downs; (4) number of successful and unsuccessful third and fourth downs conversions attempts for a first down; (5) number of drives and how they end; (6) number and types of successful and unsuccessful extra point attempts; (7) number and types of punts and number of opponent punt runbacks; (8) number and types of kickoffs and number of opponent kickoff runbacks; (9) number of fumbles and how many were recovered and how many were lost; and (10) number of penalties on defense and offense. Additionally it is desirable to know the down and the number of plays in the current drive, and number of plays in previous drives.

Many of the foregoing statistics are of interest to indicate a team's progress; to compare its performance to that of its opponent during the game; to compare to the team's season statistics to date; and/or to compare to football statistics, in general. Two examples will illustrate the importance of accurate and complete statistics that are readily available. In example one, a team has its quarterback sacked for a loss on six occasions in the first half of a game. In itself this is certainly a negative statistic for that team. It becomes of more significance when compared with the opponent whose quarterback was not sacked, and in fact scrambled for a gain on three occasions during the first half. The six sacks become very significant when viewed from the fact that this offensive line had only allowed their quarterback to be sacked 8 times in the previous 5 games of the season. The efforts of today's opponent, and particularly of their defensive lineman in rushing the passer, are worthy of note. In another example, a team completes completes 18 of 20 attempted passes in the first half. This statistic is remarkable in itself. It is of interest when compared to the opponent's 2 completions in 14 attempts with 1 interception. It is of unusual recognition when viewed from the fact that this team had only completed 33 passes out of 99 attempts in the 5 games of the season. In both of the foregoing examples, there was no indication prior to the game that such unusual statistics would occur, particularly in view of the teams' season statistics to date. Much of the interest in listening to or viewing the game is lost if the statistical information is lacking. Great amounts of time, money and space are allocated to publishing a teams' season to date statistics and announcers and commentators are generally supplied with an abundance of pregame information. When this is coupled with accurate and readily available statistics during a game, the game itself is enhanced greatly.

While all of these statistics can be achieved by routine recording during the football game by a sufficient number of assistants, the sequence of events which occur during a game often happen too rapidly for an accurate recording of these statistics by a single person. It is, therefore, desirable to provide a device to facilitate the chronological recording and calculating of statistics during a football game whereby a single person can record and instantaneously read out an accurate summary of plays, drive yards, and other statistics, and the sequence in which they occurred.

A device of the aforementioned character could also be utilized as a game during a live or delayed broadcast by permitting two or more contestants to check pregame predictions or wagers by recording and indicating more accurate and complete statistical information than presently reported during the video or radio broadcasting of a football game. Broadcasters and commentators, during present television and radio coverage of a football game, often mention various statistics during the game, or at halftime, or after the game. However, these statistics are usually incomplete or quickly announced, or often eliminated to provide time for advertising, interviews, or other general interest information. There is often a similar lack of complete statistics in newspaper sports sections.

BRIEF STATEMENT OF THE INVENTION

This invention comprises a recording and calculating device of the slide rule type having a body with at least one, and preferably two grooves coextensive with its length to receive a movable slide. The slide is calibrated in indicia of even, arithmetic progression. The device is used in combination with removable marker means such as pegs of varied color, size and/or shape and can include cooperative rings, each marker means thereby bearing an indicium of a particular class of indicia. In the preferred embodiment, each peg is one of a plurality of seven or eight distinct colors, with each color representing a particular item of information concerning the recorded play. The body of the rule also bears a plurality of parallel rows of receiver means, typically holes, for receiving the removable marker means and these receiver means are positioned in columns of equal, arithmetic spacing to the spacing of the indicia carried on the slide, each column representing a particular scrimmage, rush or pass play of the game. The parallel rows provide information for passing, rushing, and first down statistics to cooperate with the indicia of the marker means to provide a multitude of recorded information. In the preferred embodiment, the groove of the body also bears a plurality of equal, arithmetically spaced, receiver means to locate removable marker means that can be inserted for recording stops for the slide, permitting the slide to provide an instantaneous readout of the number of plays in a current drive. The number of vacant holes in between markers in the groove provide a quick readout of the number of plays in previous drives.

The device can be used by statisticians for recording or broadcasting statistical information during the course of a football game. The device can also be used by sports fans and contestants to check the accuracy of pregame predictions or wagers regarding a host of statistics of a football game, many of which are not presently reported by broadcasters during the game such as number of first downs by rushing, number of first downs by passing, number of running plays, etc., made by either or both teams during a quarter, half or entirety of the game.

In the game application, each contestant fills out a statistics score sheet before the game with his predictions of certain statistics for one or both teams. The contestants can take turns keeping the actual game statistics on a device of the aforementioned invention and, at a convenient interval such as halftime, the actual game statistics are transferred from the device to the score sheet. The differences between each predicted statistic and the actual game statistics are recorded and totaled and the player with the closest predictions (lowest total of differences) is the winner. The markers can then be removed from the device and the game can be repeated for the next interval, e.g., for the second half.

BRIEF DESCRIPTION OF THE DRAWINGS

The invention will be described with reference to the illustrated and presently preferred embodiments which is shown in the figures, of which:

FIG. 2 illustrates a form useful in the game application of the invention; and FIG. 3–5 illustrate the most preferred embodiment.

DESCRIPTION OF PREFERRED EMBODIMENTS

Figure 1:
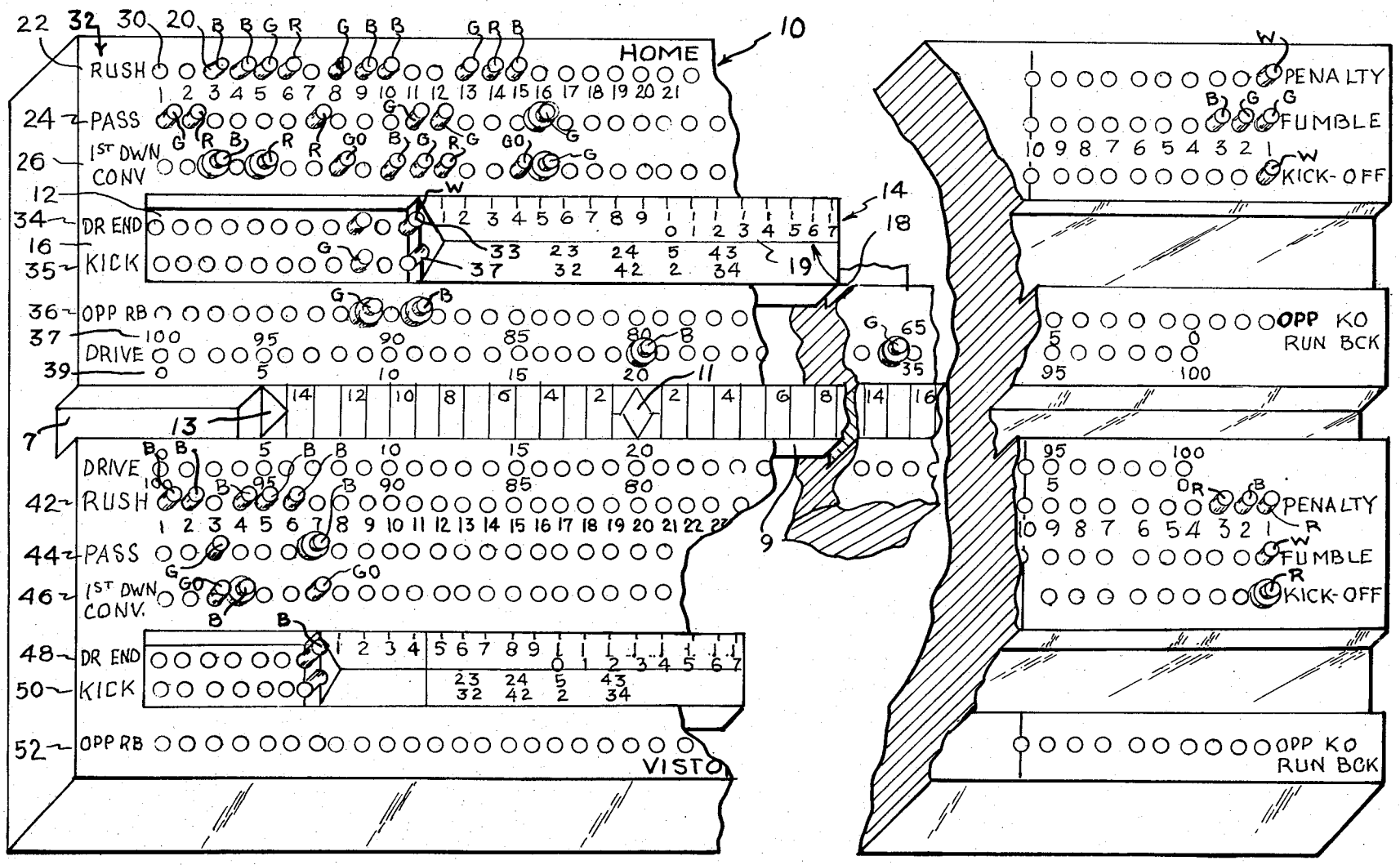
FIG. 1 illustrates a calculating device of the invention.

The calculating device of the invention is shown in FIGS. 1 and 2 as a device of a slide rule type having a body 10 bearing at least one groove 12 coextensive with its length. Although the device is illustrated as a linear rule, it is obvious that a similar construction could be employed using a circular disk and the like.

Slidably received in groove 12 is a slide 14. In the illustrated embodiment, slide 14 is operative in a progressive fashion from left to right of the rule, and accordingly, groove 12 can have a reference stop 16, terminating short of the length of rule body 10, if desired. Slide 14 bears a scale 18 calibrated in indicia 19 of integers of arithmetic progression coextension with its length.

The calculating device is employed with a plurality of distinct classes of indicia. In the preferred embodiment, the indicia are the colors of distinctly colored pegs which are depicted by code letters in the drawings according to the following table:

TABLE I

| Color | Code Letter |
|---|---|
| Pink | P |
| Blue | B |
| Green | G |
| Red | R |
| Gold | GO |
| White | W |

TABLE I-continued

| Color | Code Letter |
|---|---|
| Purple | Pu |

It is, of course, apparent that the illustrated or similar letter indicia could also be used. Each of the indicia represent a particular play of the game in the manner that will be described hereinafter.

The body 10 of the rule also has a plurality of parallel rows 22, 24 and 26 of receiver means such as holes 30 which are positioned coextensive with the length of body 10 in equal arithmetic spacing to the spacing of the indicia 19 of scale 18 on slide 14. The holes 30 are of sufficient diameter to receive the removable marker means, pegs 20 and thereby record a statistical sequence of scrimmage plays of the game. The left side of rows 22, 24 and 26 of receiver means bears a legend 32 such as : RUSH, PASS and FIRST DOWN. The right side of rows 22, 24 and 26 of the receiver means bears a legend such as PENALTY, FUMBLE and KICK OFF.

The body 10 of the rule also has two rows, 34 and 35 of holes positioned in groove 12 at equal arithmetic spacing to the spacing of the indicia 18 of scale 16 on slide 14. Rows 34 and 35 provide a breakdown of how a drive, or team possession ends. Row 34 receives pegs indicating a drive end on a rushing or passing play, i.e., touchdown, fumble or interception, unsuccessful fourth down conversion attempt for a first down, etc. Row 35 receives pegs indicating a drive end on a kick, i.e., punt, field goal attempt, etc. The end of slide 14 can bear mating notches 33 and 37 to receive pegs placed in either of rows 34 and 35 to index the rule to the hole positions of the other rows.

An additional row 36 provides for punt or field goal attempt runbacks by opponents on the left and kick-off runback statistics on the right. A punt is recorded by the insertion of a green peg in DRIVE END BY KICK, row 35 in groove 12 in the same vertical column as the last rush or pass play from scrimmage. A punt runback by the other team is recorded by inserting a green peg in OPPONENT RUNBACK, row 36 in the same vertical column; or a purple peg if the opponent runback is for a touchdown. A kick off is recorded by the insertion of a green peg in KICK OFF, row 26, right, beginning with the first hole. A kick off runback is recorded by the insertion of a green peg in OPPONENT KICK OFF RUNBACK, row 36, right, in the same vertical column or a purple peg if the opponents' kickoff runback is for a touchdown. In the case of either a punt or a kick off, an empty peghole indicates that there was no runback by the opponent. A red peg for either a punt or kick off indicates that the ball was kicked into the end zone and was automatically brought out to a specified yardline, e.g., the 20 yardline. A more significant reason for a red peg instead of a green peg indicating a punt is that it distinguishes those punts which were not run back because they went into the end zone, from those punts which were not returned for other reasons, e.g., out of bounds, fair catch, downed by defense, etc.

Row 36 can also be used to record extra point attempts by inserting a blue and red peg for a missed extra point attempts by rushing and passing, respectively, and by a gold and white peg for successful and unsuccessful extra point attempts by kicking, respectively. A ring can be placed over the blue and red pegs if the pass or rush attempt was successful. The legend on the device can include "EX. PT. ATT." to indicate this use of row 36, however the legend is shortened in the drawing for simplicity of illustration.

Table II summarizes the information which can be recorded.

TABLE II

| ROW | LEGEND | PINK | BLUE | GREEN | RED | GOLD | WHITE | PUR-PLE | RING | PLACE ON PEG COLOR | EMPTY PEG-HOLES |
|---|---|---|---|---|---|---|---|---|---|---|---|
| 22 | RUSH | — | Run | Scramble | Sack | Q.B. Run | — | — | Qtr. End | Any | For PASS on Row B |
| 24 | PASS | — | Inter-ception | Complete | In-com-plete | — | — | — | Qtr. End | Any | For RUSH on Row A |
| 26 | 1ST DOWN | Rush | Rush | Pass | Pen-alty | 3rd Dn. Miss | — | — | 3rd or 4th Dn. Made | Blue, Green, Red | Except 1st Dn. and 3rd Dn. Miss |
| 34 | DRIVE END ON RUSH OR PASS | Def. TD | Inter-ception or Fumble | — | — | 4th Dn. Miss | Rush or Pass TD | Safety | — | — | Number of Plays in each Drive |
| 35 | DRIVE END ON KICK | — | Block Bad Pass | Punt | Punt to End Zone | Field Goal Miss | Field Goal Made | Safety | Other than 4th Dn. | Any | — |
| 36 | OPPONENT RUNBACK AND | TD on Runback | 2 PAT Miss | Runback | 2 PAT Made | — | Runback for TD | — | — | — | No Runback |
| | EXTRA POINT ATTEMPT* | — | Rush Miss | — | Pass Miss | Kick Miss | Kick Made | — | Use to Mark Pegs out of Place | Any | Never |

Dn. = Down
Def. = Defensive
TD = Touchdown
PAT = Point after Touchdown
*This legend omitted from drawing for illustration purposes.

At the middle portion of the rule, a groove 7 can be provided to slidably receive slide 9 bearing scales of indicia in opposite progression from a central index 11, thereby permitting a direct indication of the yardage gained or lost on an exchange of possessions or even on a particular play. These scales can be in contrasting colors, e.g., red to the left and green to the right of index 11. If the yardage change exceeds the capacity of the reverse progression scales, e.g., is more than fifteen yards, the index 13 can be used, permitting use of the entire length of the slide 9. The body of the rule can bear rows of indicia such as 37 and 39 arranged in pairs above and below slide 9 with each pair of rows including a row of indicia in football grid progression as in row 39 and the other row indicating the total yards from the opponent's goal line as in row 37. Holes to receive pegs can be provided to record drive start and end yardlines or other related information. The following table indicates how some information can be recorded.

TABLE III

| LEGEND | BLUE | GREEN | RED | GOLD | WHITE | PURPLE | RING | PLACE ON COLOR | EMPTY PEGHOLES |
|---|---|---|---|---|---|---|---|---|---|
| DRIVE START YARDLINE | Drives 1, 2 & 3 | — | — | Endzone — | Drives 4, 5 & 6 | Drives 7, 8 & 9 | 1, 2 or 3 rings on each color. | Any | |
| DRIVE END YARDLINE ON RUSH OR PASS | Inter-ception or Fumble | — | — | 4th Dn Miss | — | Defense Score | — | | |
| DRIVE END* YARDLINE ON KICK | Quick Kick | Punt | Punt to endzone | Field Goal Miss | Field Goal Made | Defense Score | — | | |
| SCORE ON RUSH OR PASS | If TD is on Drives 1, 2 & 3 | — | — | — | If TD is on Drives 4, 5 or 6 | If TD is on Drives 7, 8 or 9 | 1, 2, or 3 rings corres-ponding to Dr Start. | Any | None atfer 1st Score |
| SCORE ON OTHER | Inter-ception or Fumble Defense TD | — | Punt or Kickoff Runback TD | — | Field Gold Made | Safety | — | | |

*This legend shortened to "DRIVE" on drawing for illustration purposes.

The opposite end of body 10 can bear other indicia associated with one or more of the rows 22, 24, 26 or 36. As there illustrated, these rows are provided with the legends: PENALTY, FUMBLE, KICK OFF and OP- PONENT KICK OFF RUNBACK. The punt by the home team is recorded by insertion of the green peg in the hole adjacent the KICK legend. The run back by the visiting team is recorded in the OPPONENT RUNBACK row by inserting the green peg where shown. Table IV summarizes the recording of this information.

FIRST DOWN row 26 indicates a successful third down conversion to a first down.

The fourth play, on first down was a running play as indicated by a blue peg on RUSH row 22. The fifth play, on a 2nd down, was a quarterback scramble for a gain as indicated by a green peg on RUSH row 22. The quarterback fumbled as he was being tackled, but recovered his own fumble as indicated by a green peg at number one on the right end of row 24, labelled FUMBLE.

TABLE IV

| ROW | LEGEND | BLUE | GREEN | RED | (Right Side) GOLD | WHITE | PURPLE | RING ON COLOR | | EMPTY PEGHOLES |
|---|---|---|---|---|---|---|---|---|---|---|
| 22 | PENALTY | On Offense | — | On Defense | — | Voided an Offense Score | Voided a Defense Score | Half End | Any | None after 1st Penalty |
| 24 | FUMBLE | Lost on a Rush or Pass | Recovered | Lost on a Runback | — | Lost on-side kick | — | Half End | Any | None after 1st Fumble |
| 26 | KICKOFF | — | Kickoff | Kickoff to Endzone | On side Kick Miss | On side Kick Made | Free Kick | Half Start and Half End | Any | None after 1st kickoff |
| 36 | OPPONENT KICKOFF RUNBACK | — | Runback | Runback TD | — | — | — | — | — | No runback |

EXAMPLE I

The rule is illustrated in FIG. 1 as it would be employed to record a sequence of plays of a football game. Each column of receiver means represents a single scrimmage play of the game and are numbered successively beginning at one. As the play occurs, the observer inserts a peg 20 bearing the appropriate indicium for the play, locating the peg in a respective one of the three rows which are identified as pass, rush and first down.

The user of the rule can, at any time during the game, merely inspect the rule to recall the sequence of plays which are recorded, as they occur, in the manner described in the following paragraphs.

The visitor team kicked off into the home end zone as indicated by a red peg at number one on KICKOFF row 46 at the visitor's right of the pegboard. A ring was placed over the red peg to indicate the opening kickoff of the half. Since there was no runback, no peg was placed at opponent KICKOFF RUNBACK row 52, right.

A blue peg (with one ring) was placed at the 20 yardline on the home drive start yardline on the home drive start yardline row 37 to indicate the first home drive in the half started 20 yards from own goal and 80 yards to opponent's goal. Blue pegs are set at the 1st, 2nd and 3rd drive start yardlines in the half, white pegs are placed at the 4th, 5th and 6th, and purple pegs at the 7th, 8th and 9th drive start yardlines. One, two or three can be placed over each blue, white or purple peg to distinguish the pegs from each other, and also from drive end yardline pegs.

The first play from scrimmage for the home team was a completed pass as indicated by a green peg on PASS row 24. The next, second down play, was an incomplete pass as indicated by a successive red peg on that row. The third down play was a rushing play as indicated by a blue peg on RUSH row 22. The play was good for a first down as indicated by a blue peg on FIRST DOWN row 26, in the same vertical column as the last (blue) peg on RUSH row 22. A ring over the blue peg on The sixth play, on 3rd down, was a running play for no gain. However, the defense was offside as indicated by a red peg at number one on the right end of the VISITOR PENALTY row 42. The penalty resulted in a first down by penalty as indicated by a red peg on FIRST DOWN row 26. Since the running play was voided by the penalty, no blue peg is present on RUSH ROW 22, and the red peg was inserted on FIRST DOWN row 26 under the preceeding green peg on RUSH row 22. A ring was placed over the red peg on FIRST DOWN row 26 to indicate a successful third down conversion to a first down. The sixth play, which was recorded, was on 1st down, and was a quarterback sack for a loss as indicated by a red peg on RUSH row 22. The seventh play, on 2nd down, was an incomplete pass as indicated by a red peg on PASS row 24. The eight play, on 3rd down, was a running play for a touchdown. However, the offense was guilty of holding penalty as indicated by a white peg at the first peghole on the right end of row 22, labelled PENALTY. A blue peg would normally be placed for a penalty against the offensive unit, but in this case a white peg is substituted to indicate that the penalty cost the offense a touchdown. The running play was voided by the penalty and no blue peg is placed on RUSH row 22. Statisticians might, however, differ on whether or not this play was an unsuccessful 3rd down conversion attempt to a first down. If it is to be recorded as an unsuccessful attempt, then a gold peg would be placed on FIRST down row 26 under the preceeding red peg on RUSH row 22. (The drawing does not show a gold peg under the red peg) The eight play, again on 3rd down was a quarterback scramble for a gain as indicated by a green peg on RUSH row 22. The play was not enough for a first down and a gold peg on FIRST DOWN row 26 under the green peg on RUSH row 22 indicates an unsuccessful third down conversion attempt for a first down.

The home team punted as indicated by a green peg in DRIVE END BY KICK row 35 under the gold peg on FIRST DOWN row 26. The punt was returned by the opponents, but not for a touchdown, as indicated by a green peg on OPPONENT RUNBACK row 36. A green peg was placed at the 34 yardline on the home drive end yardline indicating the line of scrimmage at the drive end and that the drive ended by a punt. By setting slide 9 with its arrow at the blue drive start yardline peg, it can be seen that the home team's 1st drive resulted in a net gain of 14 yards by reading slide 9 at the green drive end yardline peg.

A blue peg (with one ring) is placed at the opponent's 28 yardline on the visitor's drive start yardline, indicating that the first visitor's Drive in the half started 72 yards from its own goal and 28 yards from the opponent's goal. This is not shown in the drawing because of space limitations.

The succeeding sequence of plays by the visitor team can be recorded and observed using similar facilities on the lower portion of the rule, such as the lower half of the rule.

On the first attempted play, an offensive lineman jumped offside and the offensive unit was penalized as indicated by a blue peg at number two on VISITOR's PENALTY row 42 RIGHT. The first play, on first down, was a rushing play as indicated by a blue peg on VISITOR'S RUSH row 42. The second play, or 2nd down, was a rushing play as indicated by a successive blue peg on RUSH row 42. The third play, on 3rd down, was completed pass as indicated by a green peg on PASS row 44. A gold peg on FIRST DOWN row 46 in the vertical column below the green peg on PASS ROW 44 indicates an unsuccessful third down conversion attempt for a first down. The fourth play, on 4th down, was a rushing play as indicated by a blue peg on RUSH row 42. The play was good for a first down by rushing as indicated by a blue peg on FIRST DOWN row 46. A ring over the blue peg on FIRST DOWN row 46 indicates a successful fourth down conversion to a first down. A ring over a blue, green or red peg on FIRST DOWN row 46, immediately following a gold peg on FIRST DOWN row 46, distinguishes a successful fourth down conversion to a first down from a successful third down conversion to a first down. In other words, it is necessary to have an unsuccessful third down conversion attempt (gold peg) before a fourth down attempt is possible. The fifth play, on 1st down, was a rushing play as indicated by a blue peg on RUSH row 42. The sixth play, on 2nd down, was also a rushing play as indicated by a successive blue peg on RUSH row 42. The seventh play, on 3rd down, was an intercepted pass as indicated by a blue peg on PASS row 44. A blue peg on DRIVE END row 48, in the same vertical column indicates a drive end by interception. It should be specially noted that by referring to RUSH row 42 or PASS row 44 the significance of the blue peg on drive end row 48 becomes apparent. A blue, green or red peg on RUSH row 42, in the same vertical column, or a green peg on PASS row 44, in the same vertical column would indicate a turnover by fumble, not by interception. By substituting a purple peg for the blue peg on DRIVE END row 48 the indication is that the fumble or interception turnover was runback for a touchdown by the defense. A gold peg on FIRST DOWN row 46, in the same vertical column indicates an unsuccessful third down conversion attempt for a first down.

A blue peg (not shown) is placed on the opponent's 12 yardline on the visitor's DRIVE END yardline row indicating the line of scrimmage at drive end and "how drive ended" by interception. By setting slide 9 arrow at the blue (with one ring) drive start yardline peg it can be seen that the visitor team's first drive resulted in a net gain of 16 yards at the blue drive end yardline peg.

A blue peg and two rings (not shown) are set at the 26 yardline on the home drive start yardline grid indicating that the second home drive in the half started 26 yards from own goal and 74 yards to opponent's goal. By setting slide 9 arrow at the previous home blue peg and one ring it can be seen that the home team gained 6 yards on the exchange of possessions at the present home drive start, blue peg and two rings on slide 9.

On the following series of downs, the home team performed as follows: The ninth play, on 1st down, was a rushing play as indicated by a blue peg on RUSH row 22. The tenth play, on 2nd down, was also a rushing play as indicated by a blue peg on RUSH row 22. The runner fumbled as he was tackled but recovered his own fumble as indicated by a green peg at number 2 in FUMBLE ROW at the right end of row 24. The play was good for a first down as indicated by a blue peg on FIRST DOWN row 26. Since this was a first down on a second down play, no ring is placed on the peg. The eleventh play, on 1st down was a completed pass as indicated. by a green peg on PASS row 24. The pass resulted in a touchdown as indicated by a white peg in the same vertical column on DRIVE END row 34 in groove 12. The pass was also good for a 1st down prior to the touchdown as indicated by the green peg in the same vertical column on FIRST DOWN ROW 36. [A blue peg (with two rings) is set at row 1 in HOME SCORE row H (in opponent's endzone) indicating the first home score was an offensive touchdown and occurred at the end of the second drive, or possession in the half.] The extra point attempt was a rushing play as indicated by a blue peg in the same vertical column in the OPPONENT RUNBACK AND EXTRA POINT ATTEMPT row 36. A ring over the blue peg indicates that the extra point attempt by rush was successful. By referring to the blue peg with two rings, drive start yardline peg, it can be seen that the touchdown drive covered 74 yards by referring to the yards to opponent's goal scale.

The succeeeding home kickoff was an on side kick in which possession was regained by the home team as indicated by a white peg at number one on the HOME KICKOFF row 26 right. Many statisticians view a successful onside kick as a turnover similar to an interception or a lost fumble. Thus a white peg may be placed at number one on VISITOR FUMBLE row 44 right. A blue peg, with three rings (not shown) is placed on the home yardline grid at the opponent's 47 yardline indicating that the 3rd home drive in the half started 53 yards from own goal and 47 yards to opponent's goal. By setting slide 9 arrow at the previous home blue peg with two rings it can be seen that the home team gained 27 yards on the exchange of possessions at the present home drive start blue peg with three rings on slide 9.

The succeeding series of plays by the home team is as follows. The twelfth play, on 1st down, was a completed pass as indicated by a green peg on PASS row 24. The completed pass was not enough for a 1st down, but the defense was guilty of unnecessary roughness while tackling the pass receiver. The penalty is indicated by a red peg at number 3 in VISITOR PENALTY row 42 right. The penalty resulted in a first down by penalty as indicated by a red peg in FIRST DOWN 26, in the same vertical column as the green peg on PASS row 24. The thirteenth play, on 1st down, was a quarterback scramble for a gain as indicated by a green peg in RUSH row 22. The fourteenth play, on 2nd down, was a quarterback sack for a loss as indicated by a red peg on RUSH row 22. The fifteenth play, on 3rd down, was a rushing play as indicated by a blue peg on RUSH row 22. A gold peg on the FIRST DOWN row 26 in the same vertical column indicates an unsuccessful third down conversion attempt for a first down. The sixteenth play, on 4th down, was a completed pass as indicated by a green peg in PASS row 26. A ring over the green peg on first DOWN row 26 indicates a successful fourth down conversion to a first down. However, the pass receiver fumbled when tackled and the visitor team recovered. This can be indicated by a blue peg in DRIVE END row 34 (not shown). A blue peg is also placed at number 3 in FUMBLE row 24 right. A blue peg (not shown) is placed at the opponent's 30 yardline on the home drive end yardline grid indicating the yardline where the fumble lost occurred. By setting slide 9 arrow at the drive start yardline peg with three rings it can be seen that the home team's third drive resulted in a net gain of 17 yards at the blue peg indicating drive end yardline on slide 9.

The first quarter ended with this play. A ring is thus placed over the green peg at the sixteenth play for the home team, and also another ring is placed over the blue peg at the seventh play for the visitor team, indicating the last scrimmage play in the first quarter for both teams.

The following is a summary of the sum of the home team statistics at the end of the first quarter that can be quickly observed. There were sixteen scrimmage plays, of which ten were rushing plays that included 3 quarterback scrambles for gain and two quarterback sacks for loss. Six passing plays can be broken down into four complete, two incomplete and no interceptions. There were a total of six first downs of which two were by rushing, two were by passing, and two were by penalty. There were four third down conversions attempts for a first down, of which two were successful. The one fourth down conversion attempt was successful. There were 3 drives, the first had a 14 yards net gain in eight plays. The second drive went 74 yards in 3 plays for a touchdown. The third drive had a net gain of 17 yards in 5 plays before the lost fumble. Other significant statistics for the home team in the first quarter include: (1) one penalty which nullified a touchdown; (2) three fumbles, of which one was lost; and (3) one kickoff which was a successful on side kick. Other yardage information that can be quickly compiled for the home team is the average drive start yardline. This figures can be calculated by adding the yards from the team's own goal at each of the three drive start yardline pegs (blue with one, two and three rings) 20 at the first, 26 at the second, and 53 at the third for a total of 99 yards. By dividing this total yardage figure by the number of drives, three, it can be determined that the home team's average drive start yardline during the first quarter was its own 33 yardline. Also of interest, and quickly available, is that the home team gained a total of 105 net yards in the first quarter.

Similar statistics for the visitor team in the first quarter can be observed. A comparison of statistics between the two teams is also available. It can be ascertained at a glance that the home team ran more than twice as many plays from scrimmage as did the visitors and had possession of the ball three times to the visitors once. The home team had relatively poor field position except after their successful on side kick. The visitor team had an excellent opportunity on their one possession but failed to capitalize on it due to an interception.

Statistics are also kept to the right of the rule since a device of the aforementioned character also provides an easy method for keeping PENALTY row 22 RIGHT, FUMBLE row 24 RIGHT and KICKOFF row 26 RIGHT statistics for the entire game with a means of indicating which of the statistics occurred in the first half of the game and which occurred in the 2nd half. This is accomplished by placing a ring over the last peg on each of the aforementioned row on the right at the end of the first half. If a particular statistic such as a fumble did not occur in the first half then there is no peg on that row and no ring can be placed. At the end of the game if there are one, or more, pegs on the FUMBLE row with no ring, it is immediately evident that the fumble statistics all occurred during the second half. It should further be noted that a device of the aforementioned character also provides an easy and entirely optional method for keeping or retaining 1st half total statistics on the device during the 2nd half on RUSH row 22 for 1st half total scrambles and sacks; on PASS row 24 for 1st half total interception, completed passes and incompletions; and on 1st DOWN row 26 for 1st half total first down by rush, by pass and by penalty. In addition on FIRST DOWN row 26, and on row 36, means are provided for retaining 1st half total successful and unsuccessful third down conversion attempts for a first down, also if desired, the retention of first half total successful and unsuccessful fourth down conversion attempts for a first down.

A significant advantage of the device is that it provides both the statistician at a football game, and player in front of the TV set with a multitude of options on which statistics are desirable to keep. These options range upward from a minimum few, i.e., eliminating quarterback scrambles and sacks on RUSH row 22 in favor of only one category, namely running plays; eliminating first down by rush, by pass and by penalty, in favor of only one category, namely first downs on FIRST DOWN row 26, or eliminating third down conversion attempts for a first down entirely on CONVERSTION ATTEMPT row 26.

A significant advantage of the device is that use of only a few distinct indicia for the pegs in combination with the location of a peg in one of only a few rows of holes can record essentially every type of play that can occur during a football game.

Slide 14 can be used at any time to observe the statistics for a single drive. The slide is placed against the last peg or pegs in groove 12, as shown, for the last drive sequence by the home team, against the white peg in the drive end row. In this position, it can be seen that the fifth play in the last drive was the completed pass for a first down and that, for example, the third play of the drive was a running play.

Slide 14 can also be provided with averaging indicia such as the two columns of integers beneath the sixth, eight, tenth, twelth, etc., play number. These columns indicate, for instance, that if there were 2 first downs by the sixth play, the average number of plays per down was three, or if there were 3 first downs, the average number of plays per down was two.

Slide 14 can also be used to determine 1st, 2nd, 3rd or 4th down during a drive. The slide is placed against the last peg in groove 12 at the start of each drive. After each 1st down peg is set on row 26, during the drive, slide 14 is set at that peg. 1st, 2nd, 3rd, or 4th down is easily identified with the pegs on rows 22 and 24 in the same vertical column.

As previously mentioned, the device can be used in a game or contest to record statistics of a game which are the subject of the contest. In this application each contestant can fill out a statistical score sheet with his pregame predictions. A typical score sheet can be as shown in FIG. 2.

The play statistics are recorded on the device of the invention by one or more of the contestants. At the end of each half, the total actual statistics of the plays are determined and entered in the column entitled "ACT". The numerical differences between entries in this column and those in the predicted (PRED) column are determined and entered in the difference (DIFF) column. The latter column is summed to determine the contestant's score. The contestant having the lowest numerical score has most closely predicted the game statistics and is the winner.

The invention has been described with reference to the presently preferred and illustrated embodiment thereof. It is not intended that the invention be unduly limited by this illustration and description. Instead, it is intended that the invention be defined by the means, and their obvious equivalents, set forth in the following claims.

Figure 5:
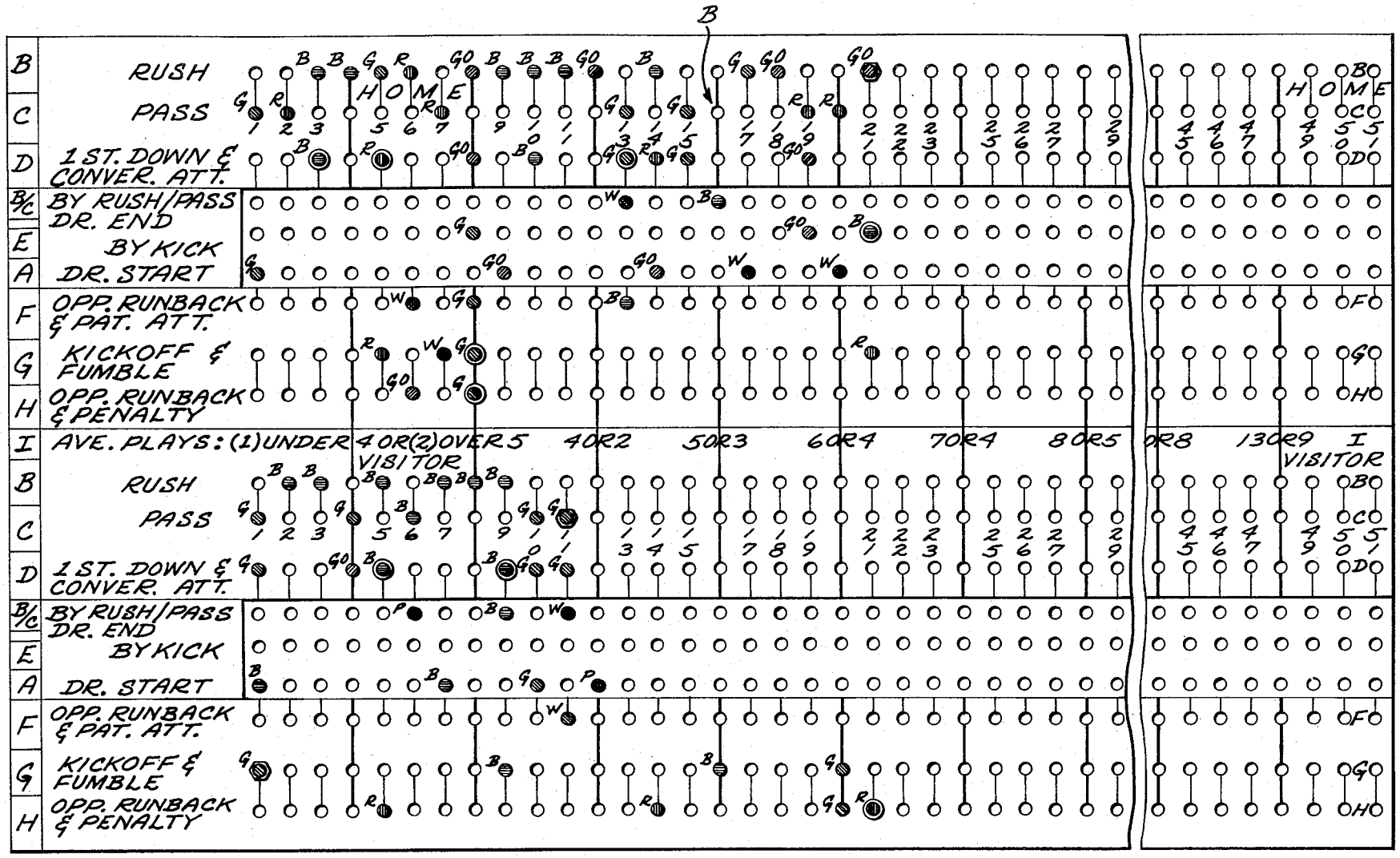

The rule shown in FIGS. 3–5 is substantially similar to that of FIG. 1, however, it has added features which expand its capabilities for recording play statistics. This rule has a body 11 with two parallel grooves 13 and 21, which receive interchangeable slides 15 and 17. Slide 15, entitled "Slide A Offense" is placed in groove 13 when the home team has possession and in grove 21 when the visitor team has possession. Slide 17 which is entitled "Slide B Team on Defense," is placed in the remaining groove, corresponding to the team on defense. Slide 17 has a flange portion 17*a* which overlies the rows of pegholes in lines B, C and D of the visitor team portion of the rule, thereby preventing a user from inadvertently placing a peg in the wrong portion of the rule.

The body 11 of the rule has the same parallel rows B, C and D of holes 30 which are the same as rows 22, 24 and 26 for the rule shown in FIG. 1 to record rushing, passing and first down conversion attempts. Row B/C provides recording of drives which ended by a rushing or passing play while row E permits recording of drives ended by a kick (similar to row 35 of FIG. 1). The row A is new with this embodiment, it provides recording the start of each drive and can be used with color coded pegs to indicate the approximate ball position at the drive start as follows:

TABLE V

| Peg Color | Starting Yardline |
|---|---|
| Pink | Between own goal line and 25 yardline |
| Blue | Between own 25 yardline and midfield |
| Green | On own 20 yardline |
| Gold | Between midfield and opponent's 25 yardline |
| White | Between opponent's 25 yardline and goal |

Row F is the same as row 36 of the FIG. 1. Row G is new with this embodiment since it provides for recording of kickoff and fumble statistics which required two rows of holes on the opposite end of the rule of FIG. 1. Similarly, two rows of holes at the opposite end of the rule of FIG. 1 are consolidated in row H, which provides for recording opponent kickoff, runback and penalty statistics. Row I provides for a rigid evaluation of a team's performance, as will be described following Example II, hereinafter.

EXAMPLE II

The user of the rule shown in FIGS. 3–5 can, at any time during each half or period of the game, merely inspect the device to recall the sequence of plays which were recorded, as they occurred, in the manner as described in the following paragraphs.

The visitor team kicked off into the home team end zone, beginning the half. This was indicated by placing a green peg in the vertical column 1 on the visitor peg board kickoff and fumble, row G. Since there was no runback, no peg was inserted at the opponent runback and penalty row H. If a runback had occurred, it would be indicated by placement of a green peg on the opponent runback and fumble row H in the same vertical column, column 1, as that column used to record the green peg for the kickoff. A pink peg inserted on row H would indicate an opponent runback for a touchdown. If desired, the opening kickoff of the half could also be registered by placing a red ring over the green peg of the visitor kickoff and fumble row G.

The commencement of the drive by the home team is recorded by placement of a green peg in the vertical column 1 on the home pegboard drive start row A, the green color indicating that the first home team drive in the half started on the home team's 20 yard line.

The slide 15, entitled slide A OFFENSE, is placed in the home team groove 13 against the green drive start peg in vertical column 1 on the drive start row A. The number 1 column on slide A offense is thus directly in line with the vertical column 1, indicating that the play in that vertical column is a first down play. Slide 17, DEFENSE is placed in the visitor groove 19 as far left as possible. This slide prevents the user from placing pegs in the wrong team's pegboard since the slide portion covers the vertical column of peg holes immediately following the vertical column containing that team's last drive end peg.

The first play (on first down) for the home team was a complete pass and was registered by placement of a green peg in the PASS row C. The second play, on second down, was an incomplete pass as registered by placement of a successive red peg in the PASS row. The third play on third down was a running play and this is registered by placement of a blue peg in the RUSH row B for the home team. This play was good for a first down and this is indicated by the placement of a blue peg in the FIRST DOWN AND CONVERSION ATTEMPT row D, in the same vertical column 3 as the last blue peg on the RUSH row B. A ring placed over the blue peg on the FIRST DOWN AND CONVERSION ATTEMPT row D indicates a successful third down conversion.

In the sequence of plays, the slide 15 is then moved so that the number 1 position on the slide is directly in line with the vertical column 4 indicating that the play in that vertical column is a first down play. This is illustrated in FIG. 3. The fourth play of this sequence, which was on first down, was a running play and was registered by placement of a blue peg on the RUSH row B in the fourth column. The fifth play, which is recorded in the fifth column on the board, occurred on second down and was a quarterback scramble for a gain as indicated by placement of a green peg on RUSH row B. The quarterback fumbled as he was tackled but recovered his own fumble as indicated by placement of a red peg on the KICKOFF AND FUMBLE row G in the same vertical column 5 as the last green peg on rush row B.

Referring now to FIG. 5, the succeeding sequence of the plays will be described. The defense was offside on the sixth play, and a red peg was placed in the visitor pegboard OPPONENT RUNBACK AND PENALTY row H. This penalty resulted in a first down by penalty as registered by a reg peg on the FIRST DOWN AND CONVERSION row D for the home team. A ring was placed over the red peg to indicate a successful third down conversion to a first down. Since the play was voided by the penalty, no play peg is present in vertical column 6, e.g., no blue peg is inserted for a running play and the red peg with the ring for the first down conversion attempt in row D is placed in the same vertical column as the last green peg on the rush row B. The red peg on the OPPONENT RUNBACK AND PENALTY row H for the visitor team (on defense) was also placed in the same vertical column 5 as the last green peg on RUSH row B of the home portion of the peg board.

Since the penalty resulted in a first down, the slide 15, offense, was moved forward in groove 13. The sixth play, which was a first down play, was a quarterback sack as registered by placement of a red peg in RUSH row B for the home team. On the seventh play, second down, the home team completed a pass. The home team was guilty of an illegal motion and a penalty was assessed and registered by placement of a gold peg in the home OPPONENT RUNBACK AND PENALTY row H. Since the completed pass was voided by the penalty, no green peg was inserted in the vertical column 7 of PASS row C. The gold peg on the OPPONENT RUNBACK AND PENALTY row H of the home team pegboard was thus placed in the same vertical column 6 as the last red peg on RUSH row B.

The seventh play, again on second down, was an incomplete pass, as indicated by placement of a red peg in PASS row C of the home team. The eighth play, on third down, was a quarterback keeper (not a scramble for a gain or sack for a loss) as registered by placement of a gold peg on RUSH row B for the home team. This play did not gain enough for a first down as indicated by a gold peg in the FIRST DOWN AND CONVERSION ATTEMPT row D in the same vertical column 8 as the last gold peg on RUSH row B.

The home team ended their first drive in the half with a punt as registered by placement of a green peg in the DRIVE END BY KICK row E in the same vertical column 8 as the gold peg on the FIRST DOWN AND CONVERSION ATTEMPT row D. The punt was returned by the visitor team, but not for a touchdown, and this is indicated by placement of a green peg in the OPPONENT RUNBACK AND POINT AFTER TOUCHDOWN ATTEMPT row F in the same vertical column 8 as the green peg indicating the punt on row E for the home team.

Since the visitor team runback was to their own forty-two yard line, a blue peg was set in vertical column 1 on the visitor pegboard portion DRIVE START row A to indicate that the first visitor drive in the half started between their twenty-five yard line and midfield.

At any time during a sequence of plays, the slide 15 can be placed against the green peg on the drive start row A in vertical column, e.g., vertical column 1 and the current number of plays in the drive can be read directly on slide A OFFENSE at the last peg which is inserted in either RUSH row B or PASS row C.

With the exchange of the possession, the slide A OFFENSE, slide 15 and slide A DEFENSE, slide 17, are interchanged so that the slide 15 is now in the visitor groove 19 against the blue peg in DRIVE START row A of vertical column 1. The number 1 position on slide 15 is now directly in line with vertical column indicating that the play in that vertical column is a first down play. Slide 17, DEFENSE, can be placed against the punt green peg on DRIVE END BY KICK row E in the home team groove 13 and cover the portion of the pegboard, thereby preventing one from inadvertently placing the pegs used to record plays in the wrong portion of the pegboard.

The visiting team's first play on first down was complete pass and was registered by placement of a green peg in PASS row C. This play was also good for a first down and a green peg was placed in the FIRST DOWN AND CONVERSION ATTEMPT row D in the same vertical column 1 as the green peg in the PASS row C. Since this first down occurred on a first down play, no ring is placed over the green peg.

Slide 15 OFFENSE is then advanced so that the number 1 position of the slide is directly in line with vertical column 2. This is shown in FIG. 4. The second play for the visitor team, which was on first down, was a running play and was registered by placement of a blue peg in the RUSH row B. The third play, on second down, was a running play and was registered by placement of a successive blue peg in RUSH row B. The fourth play, on third down, was a completed pass and was registered by placement of a green peg in PASS row C. The play was not sufficient to obtain a first down, and a gold peg was placed on the FIRST DOWN AND CONVERSION ATTEMPT row D, registering an unsuccessful third down conversion attempt for a first down. The fifth play, on the fourth down, was a running play and was registered by placement of a blue peg in RUSH row B. This play was good for a first down and this is registered by a blue peg which is placed in the FIRST DOWN AND CONVERSION ATTEMPT row D, in the same vertical column as the last blue peg on the RUSH row B. A ring is placed over the blue peg on the FIRST DOWN AND CONVERSION ATTEMPT row D to register a successful fourth down conversion to a first down.

The preceding description indicates a method for distinguishing a successful fourth down conversion attempt from a successful third down conversion attempt. Since it is always necessary to have an unsuccessful third down conversion attempt (registered by a gold peg) before a fourth down conversion attempt is possible, the sequence of a gold peg followed by a successive peg with a ring indicates a successful fourth down conversion attempt. In the event that the fourth down conversion attempt was also unsuccessful, a gold peg is placed in the DRIVE END BY PASS OR RUSH row B/C in the same vertical row as the last peg used to register a passing or rushing play, thereby indicating that the drive ended on an unsuccessful fourth down play.

The slide A OFFENSE, slide 15, is positioned again so that the number 1 position of the slide is directly in line with the vertical column 6. The remainder of this example is described with reference to FIG. 5, which shows that all the pegs which were placed in the board for the first quarter of the game. The sixth play for the visitor team, which was a first down play, resulted in an intercepted pass, and this is recorded on the pegboard by placement of a blue peg in PASS row C for the visitor team. The intercepted pass was returned for a touchdown and this is registered by placement of a pink peg in the DRIVE END BY RUSH OR PASS row B/C in the same vertical column 6 as the last blue peg on the PASS row C.

A reference to the placement of pegs in the RUSH row B of PASS row C with placement of pegs in the same vertical column in the DRIVE END BY RUSH OR PASS row B/C is of significance. To illustrate, the combination of a peg in the RUSH row B with a blue peg on the row B/C indicates a turnover by a fumble; a pink peg in row B/C indicates the fumble turnover resulted in a touchdown for the opposing team. A white peg in row B/C indicates a touchdown by rushing, while a purple peg in row B/C indicates a safety on a rushing play. A blue peg in the passing row C with a blue peg in the row B/C indicates a turnover by interception; a pink peg in row B/C indicates that this interception was returned for a touchdown. The placement of a green peg in the passing row C with a blue peg in row B/C indicates a complete pass with a fumble turnover by the receiver, while a pink peg on row B/C with this combination indicates the fumble turnover which occurred after a completed pass resulted in a touchdown for the recovering, opponent team. A green peg in PASS row C, with a white peg in row B/C in the same column, indicates a touchdown by passing.

The home team point after touchdown kick attempt, which followed the interception and return for a touchdown, was good and this was registered by placement of a white peg in the OPPONENT RUNBACK AND POINT AFTER TOUCHDOWN ATTEMPT row F of the home portion of the pegboard in the same vertical column 6 as the pink peg which was placed in the DRIVE END BY PASS or RUSH B/C of the visitor portion of the pegboard to register the interception for a touchdown.

The home team kickoff was a successful onside kick, which was recovered by the home team. This was indicated by placement of a white peg in the KICKOFF AND FUMBLE row G of the home portion of the pegboard in the same vertical column 7 as the OPPONENT DRIVE start peg would have been set on DRIVE START row A had the home kickoff been customary, or had their onside kick been unsuccessful. A gold peg is set in the vertical column 9 on the home portion of the pegboard in DRIVE START row A to indicate that the drive start was between the 50 yard line and the opponent's 25 yard line. The slide 15 OFFENSE is placed in the home groove 13 against the gold drive start peg in vertical column 9. The number 1 play on the slide 15 OFFENSE is directly in line with vertical column 9 indicating that the play in this vertical column is a first down play. The slide 17 DEFENSE remains in the visitor groove as before.

The ninth play, on first down, was a running play and was registered by placement of a blue peg in the RUSH row B for the home team's portion of the pegboard. The tenth play, on second down, was another running play as registered by a successive blue peg in the RUSH row B. This play was good for a first down as indicated by a blue peg on the FIRST DOWN AND CONVERSION ATTEMPT row F in the same vertical column 10 as the last blue peg on the RUSH row B. Since it was a first down on a second down play, no ring was placed over the blue peg in the FIRST DOWN AND CONVERSION ATTEMPT row.

The slide 15 OFFENSE is advanced in the home team groove 13 as previously described. The eleventh play, on first down, is a running play and is registered by placement of a blue peg in the RUSH row B. The twelfth play, on second down, was a quarterback run and was indicated by placement of a gold peg in the RUSH row B. The thirteenth play, on third down, was a completed pass, and is registered by a green peg in PASS row C. The play was good for a first down and this was registered by a green peg placed in the FIRST DOWN AND CONVERSION ATTEMPT row D in the same vertical column 13 as the last green peg on PASS row C. A ring is placed over the green peg on the FIRST DOWN AND CONVERSION ATTEMPT row D to register a successful third down conversion to a first down. The completed pass also was good for a touchdown, as indicated by a white peg, which was placed in the DRIVE END BY RUSH OR PASS row B/C in the same vertical column as the last green peg appearing in PASS row C.

The home team point after touchdown attempt was a two point attempt which was unsuccessful and this is registered by placement of a blue peg in the OPPONENT RUNBACK AND POINT AFTER TOUCHDOWN ATTEMPT row F on the home portion of the pegboard in the same vertical column 13 as the last green peg placed in the PASS row C.

The kickoff by the home team was registered by placement of a green peg in the KICKOFF AND FUMBLE row G in vertical column 8. A ring was placed over this peg to indicate that it should have been set in the same vertical column 7 as the opponent drive start peg would be set. The kickoff was returned by the opponent team but not for a touchdown as registered by a green peg placed in the OPPONENT RUNBACK AND PENALTY row H in the same vertical column 8 as the green peg on the KICKOFF AND FUMBLE row G. A ring was placed over the green opponent runback peg to indicate that it should be in the vertical column 7 where the DRIVE START peg was set for the opponent team. A blue peg is placed in vertical column 7 on the visitor portion of the pegboard in DRIVE START ROW A to register that the visitor team started between their own 25 yard line and midfield. The slide 15 OFFENSE and slide 17 DEFENSE are interchanged and positioned as previously explained. The seventh visitor play (on first down) was a running play and was registered by placement of a blue peg in RUSH row B. The eighth play, on second down, was another running play and was registered by a successive blue peg placed in RUSH row B. The ninth play, on third down, was another running play as registered by a blue peg in RUSH row B. This play was good for a first down and this is indicated by a blue peg placed in the FIRST DOWN AND CONVERSION ATTEMPT row D in the same vertical column 9 as the last blue peg on RUSH row B. A ring was placed over the peg on row D to indicate a successful third down conversion to a first down. On this play, however, the player fumbled when tackled after making a first down and the fumble was recovered by the home team and this was indicated by placement of a blue peg on DRIVE END BY RUSH OR PASS row B/C in the same vertical column 9 as the last blue peg. on RUSH row B. A blue peg was also placed in the KICKOFF AND FUMBLE row G in the same vertical column 9 as the last blue peg on RUSH row B. A gold peg was placed in the home portion of the pegboard in DRIVE START row A in vertical column 14 to indicate that the drive start which occurred upon recovery of the fumble was between mid-field and the opponent's 25 yard line.

The slide 15 OFFENSE and slide 17 DEFENSE were interchanged and positioned as previously explained. The fourteenth play, on first down, was a running play and was registered by placement of a blue peg in the RUSH row B. The opponent team was penalized for unsportsmanlike conduct and this registered by placement of a red peg in the visitor portion of the pegboard on OPPONENT RUNBACK AND PENALTY row H in the same vertical column 14 as the blue peg in RUSH row B. The penalty on the defense team resulted in a first down, and this is registered by placement of a red peg in FIRST DOWN AND CONVERSION ATTEMPT row D in the same vertical column 14 as the blue peg in RUSH row B. The slide 15 OFFENSE was advanced as customary for commencement of a new first down series. The fifteenth play, on first down, was a completed pass and was registered by placement of a green peg in PASS row C. The play was good for a first down as indicated by a green peg on FIRST DOWN AND CONVERSION ATTEMPT row D in the same vertical column 15 as the last green peg in PASS row C. The slide 15 OFFENSE was again advanced. The sixteenth play, on first down, was an intercepted pass as registered by a blue peg placed in PASS row C. A blue peg was also placed in DRIVE END BY RUSH OR PASS row B/C in the same vertical column 16 as the last blue peg in PASS row C. On the attempted return of the interception, the defensive player fumbled and the offensive team recovered the fumble as indicated by placement of a blue peg, in the visitor pegboard portion, in KICKOFF AND FUMBLE row G in the same vertical column 16 as the blue interception peg in the DRIVE END BY PASS OR RUSH row B/C on the home pegboard.

This sequence of possessions began a new drive, which was the fourth drive for the home team in this half, and a white peg was placed in the home pegboard DRIVE START row A in vertical column 17 to indicate that the drive start was between the opponent's 25 yard line and their goal.

At any time during the half, the number of plays in each previous drive for either team can be easily determined by counting the empty pegholes between the drive start pegs on DRIVE START row A and including the DRIVE START peg as the first play in each drive. Thus, it can be readily determined that the home team had 8 plays in their first drive, 5 plays in their second drive, and 3 plays in their third drive. The new drive is started with positioning the slide 15 OFFENSE in the home team groove in the manner previously described. The seventeenth play, on first down, was a quarterback scramble for a gain as registered by placement of a green peg in the RUSH row B. The eigthteenth play, on second down, was a quarterback run and this is indicated by placement of a gold peg in RUSH row B. The nineteenth play, on third down, was an incomplete pass and this was registered by placement of a red peg in pass row C. A gold peg was set in the FIRST DOWN AND CONVERSION ATTEMPT row D in the same vertical column 19 as the last red peg in PASS row C to indicate an unsuccessful attempt for a first down. The home team attempted a field goal which was missed and this was registered by placement of a gold peg in the DRIVE END BY KICK row E in the same vertical column as the gold peg in the FIRST DOWN AND CONVERSION ATTEMPT row D.

A green peg was placed in the visitor portion of the peg board in DRIVE START row A to indicate that the drive start for the visitor team was at their own 20 yard line following the unsuccessful field goal attempt. The green peg was set in the vertical column 10 which is the vertical column next following the vertical column on which the visitor team's previous drive ended (column 9) which contains the blue peg in DRIVE END BY PASS OR RUSH row B/C.

Slide 15 OFFENSE and slide 17 DEFENSE were interchanged and positioned in the manner previously described. The tenth play for the visitor which was first down play was a completed pass as registered by placement of a green peg in PASS row C. This pass was good for a first down and a green peg was also placed in the FIRST DOWN AND CONVERSION ATTEMPT row D in the same vertical column 10 as the green peg in the PASS row C. The slide 15 OFFENSE was advanced in the previously described manner. The eleventh play, on first down, was also a completed pass and was registered by placement of a successive green peg in PASS row C. This pass was also good for a first down and a green peg was placed in the FIRST DOWN AND CONVERSION ATTEMPT row D in vertical column 11. This completed pass was also good for a touchdown and a white peg was placed in the DRIVE END BY RUSH OR PASS row B/C in the same vertical column 11 as the last green peg in the PASS row C.

The visitor team point after touchdown kick attempt was good and a white peg was placed in the OPPONENT RUNBACK AND POINT AFTER ATTEMPT row F in the same vertical column 11 as the last green peg in PASS row C.

The visitor team kickoff was registered by placement of a green peg in the KICKOFF AND FUMBLE row G in vertical column 20 of the home team portion of the pegboard, i.e., in the column immediately following the column containing the last entry for the home team, which was the gold peg in the DRIVE END BY KICK row E. The kickoff was returned, but not for a touchdown and this is indicated by a green peg in the OPPONENT RUNBACK AND FUMBLE row H in the same vertical column 20 as the green peg in the KICKOFF AND FUMBLE row G. The return of the visitor kickoff was a good return as indicated by placement of a white peg in the home pegboard DRIVE START row A in vertical column 20. The white peg indicates that the home team drive start was between the opponent's 25 yard line and their goal.

The slide 15 OFFENSE and slide 17 DEFENSE were interchanged and positions previously described. The twentieth play for the home team, which was a first down play, was a running play for a short gain. The defensive team was offside and the play was voided by the penalty. No blue peg was inserted in the RUSH row B in vertical column 20. The penalty on the defense requires placement of a red peg in vertical column 20 in the visitor pegboard portion in the OPPONENT RUNBACK AND PENALTY row H. This peghole was already occupied, however, by the opponent runback green peg which precedes the penalty peg. The red penalty peg was, therefore, set in vertical column 21 in row H and a ring was placed over this peg to indicate that the red peg also belongs in vertical column 20 of that row. Should a second consecutive penalty voiding a play occur, another red peg with a ring would be placed in the row H, this time in vertical column 19.

The twentieth play for the home team, again on first down was an incomplete pass as indicated by a red peg placed in the PASS row C. The twenty-first play, on second down, was a quarterback sneak and was indicated by placement of a gold peg in RUSH row B. The quarterback fumbled but recovered his own fumble and this was registered by placement of a red peg in the KICKOFF AND FUMBLE row G in the same vertical column 21 as the gold peg in RUSH row B. On the next play, on third down, with time running out in the first quarter, to take advantage of the wind at their back, the home team attempted a field goal which was blocked and this was registered by placement of a blue peg in the DRIVE END BY KICK row E in the same vertical column 21 as the last gold peg in RUSH row B. A ring was placed over the blue peg on DRIVE END BY KICK row E to indicate that the field goal attempt occurred on other than a fourth down play. The visitor team recovered the blocked field goal attempt on their own 17 yard line and a pink peg was placed in the visitor portion of the pegboard in DRIVE START row A in vertical column 12, which is the column immediately following the last column used during the visitor team's previous drive. The pink peg placed in the drive start row A indicates that the visitor team begin their play between their own goal line and their 25 yard line.

Slide 15 OFFENSE and slide 17 DEFENSE were interchanged and positioned as previously described. The first quarter ended on the blocked field goal attempt and this end of the quarter was registered by placement of a red ring over the last gold peg in vertical column 21 of the home portion of the pegboard, and also over the last green peg in the visitor pegboard PASS row C in vertical column 10.

The device of this invention can be used to provide a very useful summary of the statistics at the end of any period during the game. The following is a summary of the slide. The home team had five drives. The first drive began on their 20 yard line, and comprised 8 scrimmage plays, ending with a punt. The second drive began between mid-field and the opponent's 25 yard line and took five plays to score a touchdown, which was scored on a passing play. The third drive also started between mid-field and the opponent 25 yard line and ended on a pass interception after three plays. The fourth drive began between the opponent's 25 yard line and their goal line and ended after three plays with an unsuccessful field goal attempt. The fifth drive also began between the opponent's 25 yard line and their goal and ended two plays later with a blocked field goal attempt on other than a fourth down.

The home team can be seen to have run 21 scrimmage plays of which 13 were rushing plays, including two quarterback scrambles for a gain and one quarterback sack for a loss. Four quarterback runs were also recorded. The 8 passing plays resulted in three completions, four incompletions and one interception. The home team had a total of six first downs, two by rushing, two by passing, and two by penalty. There were five third-down conversion attempts of which three were successful. There were no fourth down conversion attempts. There was only one punt by the home team which was returned by the visitor team, but not for a touchdown. There were two point after touchdown attempts, the first was a successful kick and the second was a two-point attempt that was unsuccessful. There were two kickoffs, one of which was an onside kick that was successfully recovered by the home team. The other kickoff was returned by the opponent team, but not for a touchdown. The home team fumbled twice and recovered both fumbles. There was one penalty against the home team's offensive unit.

Similar statistics for the visitor team can be observed from the rule. A comparison of statistics between the two teams can also be quickly made. The comparisons that can be made show that the home team have five drives to three drives by the visitor team. The home team had good field position since four of their five drives began in their opponent's territory. The three visitor drives all began in their own territory. A glance at the rule indicates that the home team ran almost twice as many plays from scrimmage as did the visitor team. The home team had only one turnover on an interception, which was immediately recovered when the visitor return of the interception resulted in a recovered fumble. That visitor fumble turnover was one of three turnovers by the visitor team during the first quarter, two by fumbles and one by interception, the latter being run back for a touchdown.

Other comparisons and information which are not statistics but are of interest to one following the progress of a game can be quickly determined from the rule. The home quarterback was forced to scramble twice and was sacked once indicating that the visitor team pass rush was quite good. The home quarterback was used as a ball carrier quite often (four times) as indicated by the four gold pegs in the RUSH row B of the home pegboard. These four quarterback carries when combined with two scrambles and one sack, indicates that the quarterback carried the ball on one-third of the twenty-one home scrimmage plays in the first quarter. The rule indicates the quarterback's importance by showing that he either passed or carried the ball on fifteen plays (eight passes and seven rushes), of his teams twenty-one scrimmage plays. By comparison the visitor quarterback did not run with the ball. His passing, however, was much better since he completed four our of five attempts with one interception which was run back for a touchdown.

The device provides a quick evaluation of the performance of each team's offensive and defensive units. In the middle of the rule, row I is entitled AVERAGE NUMBER OF PLAYS. This row bears a series of paired numbers appearing at the vertical columms 12, 16, 20, 24, 28, 32, 36, 40, 44 and 48. The first number of each pair of numbers is the number of first downs needed at that particular number of scrimmage plays to average under four plays to gain each first down. This first figure (the under four figure) can be compared to the total number of first downs on FIRST DOWN AND CONVERSION ATTEMPT row D. As previously mentioned, a blue peg in row D indicates a first down by rushing, a green peg indicates a first down by passing, and a red peg indicates a first down by penalty. If the total first downs on the FIRST DOWN AND CONVERSION ATTEMPT row D are the same or more than the under four number on AVERAGE PLAYS (row I), the average is less than four plays to gain each first down and the offensive team can be evaluated as controlling the opponent's defensive tema. The second figure, i.e., the over five figure, of each pair of numbers, is the number of first downs needed at that particular number of scrimmage plays indicated to average over five plays to gain each first down. This second figure, the over five figure, is compared to the total number of first downs on the FIRST DOWN AND CONVERSION ATTEMPT row D. If the total first downs on the FIRST DOWN AND CONVERSION ATTEMPT row D are the same or less than the over five number on AVERAGE PLAYS (row I), the average is more than five plays to gain each first down and the offense can be evaluated as being controlled by the defense.

The following chart indicates the average plays per first down for the first and the second figures as they appear on the top of every fourth vertical column of peg holes beginning at the twelfth vertical column:

| NUMBER OF PLAYS | 12 | 16 | 20 | 24 | 28 | 32 | 36 | 40 | 44 | 48 |
|---|---|---|---|---|---|---|---|---|---|---|
| (1) Under 4 | 4 | 5 | 6 | 7 | 8 | 9 | 10 | 11 | 12 | 13 |
| Avg. Per 1st Dn. | 3.0 | 3.2 | 3.3 | 3.4 | 3.5 | 3.6 | 3.6 | 3.6 | 3.7 | 3.7 |
| (2) Over 5 | 2 | 3 | 4 | 4 | 5 | 6 | 7 | 8 | 8 | 9 |
| Avg. Per 1st Dn. | 6.0 | 5.3 | 5.0 | 6.0 | 5.6 | 5.3 | 5.1 | 5.0 | 5.5 | 5.3 |

The comparison between the number of first downs on FIRST DOWN AND CONVERSION ATTEMPT row D with the FIG. 1 (under four) or FIG. 2 (over five) on AVERAGE PLAYS row I is based on the following evaluation of average plays for first down. An average of exactly three scrimmage plays to gain each first down is perfect for the offensive team. An average of under four scrimmage plays to gain each first down is close enough to perfect to assign the evaluation that the offense is controlling the defense. An average from four to five scrimmage plays to gain each first down can be considered fair, however, the offensive team is neither controlling or being controlled by the defensive team. When the average of scrimmage plays to gain each first down is over five, the offensive team is being controlled by the defensive team.

An example will illustrate the comparison of first downs on the first down and conversion attempt row D with the FIG. 1 (under 4) or FIG. 2 (over 5), on AVERAGE PLAYS row I. A team's offense runs 32 plays from scrimmage and that team's last play is recorded in either the RUSH row B or PASS row C in vertical column 32. At the middle of the rule (row I), the numbers 9 or 6 appear. If the number of first downs on the FIRST DOWN AND CONVERSION ATTEMPT row D are nine or more, the offense is averaging less than four plays to gain each first down, and the offensive team can be said to be controlling the defense. If the total number of first downs determined from row D is 6 or less, the offense is averaging more than five plays to gain each first down and the offense is being controlled by the defense. If the number of first downs on the row D is 7 or 8, the offense is neither controlling or being controlled by the defense.

This comparison between the first downs and the UNDER Four and OVER Five figures for the AVERAGE PLAYS Row I has a number of important considerations. First, the average plays for a first down is infrequently mentioned and is generally not used because of the difficulty in determining and recording the exact number of plays, the number of 1st Downs, and the appropriate UNDER 4 and OVER 5 figures at any given point in time during the game. The device is designed to provide this information quickly and accurately at a regular and predetermined point of reference during the progress of the game. Second, the value of this AVERAGE PLAYS statistic as an evaluation of a team's offensive efforts surpasses many other more frequently mentioned statistics such as successful and unsuccessful third down conversion attempts for a first down, or passing completion percentage. The former statistic can be misleading in that a team's offense can be dominating the defense by making a number of first downs on first or second down plays. This fact will not be reflected in the third down conversion statistic because the third down conversion situation is occuring only occasionally. AVERAGE PLAYS per first down would quickly and consistently indicate this offense domination of the defense. Likewise, the latter statistic, namely pass completion percentage can be misleading. An offense can be attempting a lot of passes and completing a high percentage of these pass attempts, i.e., 60 to 70 percent. Yet, the offense may not be controlling the defense because many of these pass completions are for short yardage, or for no gain, or occasionally may result in a loss of yardage due to excellent defensive play. Also in attempting these passes the quarterback may have been sacked for a loss on several occasions. Also, while the offense passing completion percentage may be very good, its running game is not able to advance the ball against the defense. AVERAGE PLAYS per first down would indicate the fact that the defense was controlling the offense because very few first downs were being made and the offense was taking over five plays to gain each of their first downs.

Third, the accuracy of the AVERAGE PLAYS per first down increases with the number of scrimmage plays. The first twelve or sixteen plays indicates a trend while twenty or twenty-four plays provides a good indication of how well a team's offense is doing. When the number of plays are twenty-eight or more, this is a very excellent indicator of the performance of a team's offense.

Fourth, many statistics such as time of possession, or number of scrimmage plays run, etc., are either hard to record or are of little value until the end of the 1st half, or the end of the game. AVERAGE PLAYS can become a useful statistic as early as the 1st quarter, and its validity improves as the game progresses. The major caution to insure the accuracy of this statistic is that all first downs must be recorded. Thus, if the offensive team scores a touchdown on a 34 yard play on the rush or a pass, the first down which occurs enroute to the touchdown must be recorded on the FIRST DOWN AND CONVERSION ATTEMPT row D for the team so that this will be evaluated in determining the teams offensive performance. It is left to the discretion of the individual statistician whether or not to record a first down to the offense when it scores a touchdown after a first down and goal-to-go situation. In the interest of accuracy for the AVERAGE PLAYS per first down statistic, a first down should be recorded if a touchdown is scored. A first down should not be recorded if a field goal attempt ends the drive after a first down and goal-to-go situation because the defense has prevented the touchdown and forced the offense to go for the next best avenue of scoring.

In the foregoing example, at the end of the first quarter, both the home and the visitor offensive units were controlling the respective defensive units. The home team had six first down (recorded in row D) for 21 scrimmage plays or an average of less then four plays to gain each first down. The visitor team had five first downs (recorded in their row D) in less than twelve scrimmage plays. The visitor team did not have a sufficient number of plays to obtain a reliable or good evaluation of their performance, instead this statistic indicates a favorable trend for the visitor team offensive unit. Since both teams had three first downs on three consecutive srimmage plays, which is an unusual situation, it is logical to assume that one or both of these teams will not be able to maintain their low average number of plays per first down.

The comparison of first downs on FIRST DOWN AND CONVERSION ATTEMPTS in row D with the under 4, or over 5 figure on AVERAGE PLAYS row I when viewed in conjunction with other statistics recorded on the device during the first quarter indicates that both teams have offensive units which are capable of moving the ball. It appears at the end of the first quarter that the game will be high scoring and the respective defense teams are facing a difficult remaining three quarters of the game.

A significant advantage of the invention is that it provides a multitude of options. The options permit one to reduce the number of statistics that are recorded as described in the preceding example. A simplified version coule be used to permit one to follow the course of the game more easily by reducing the number of statistics which are recorded. To illustrate, DRIVE START row A can be eliminated completely and the slide 15 OFFENSE can be placed in groove 13 against the previous DRIVE END peg on either DRIVE END BY RUSH OR PASS B/C or DRIVE END BY KICK row D. The RUSH row B can be reduced to just one category using a blue peg to indicate a run. Recording the third and fourth down conversion attempts to a first down can be eliminated by not using the ring or gold pegs in the FIRST DOWN AND CONVERSION ATTEMPT row D. Use of a pink peg for a runback for touchdown in the RUNBACK row F can be eliminated in favor of a single category using a green peg to indicate a runback. The POINT AFTER TOUCHDOWN ATTEMPT row F can be simplified by using pegs to record only misses and attempts for points after touchdown. The KICKOFF row G can employ only a green peg, the gold peg to indicate and onside kick miss, white peg to indicate an onside kick made, and purple peg to indicate a free kick, being eliminated. In the RUNBACK row H, the pink peg to indicate a runback for touchdown, can be eliminated in favor of use of green pegs only. In first down row D, the use of a blue peg to indicate first down by rushing, green peg to indicate first down by passing, and red peg to indicate first down by penalty can be eliminated in use of a single color peg, e.g., blue, to indicate a first down. The PENALTY row H can be simplified by use only of red pegs. This can reduce the total number of statistics recorded on the device from over forty to less than about twenty, increasing its simplicity and its usefulness for the more casual viewer or sports fan.

The rule provides a great capability for registering a variety of statistics. The combination of the pegs, rows and rings, including the variation of colors, greatly expands the statistic-recording capability of the rule. To illustrate, substituting a pink peg for a blue peg on the RUSH row B provides an indication of the number of times a particular ball carrier carries the ball. By use of a white peg in the same row, the number of times a particular type of play such as an end around is called, can be recorded. Similarly, the substitution of a pink peg for a green peg in the PASS row C, can be used to identify receptions by a particular receiver. A ring can be placed on the peg on RUSH row B or PASS row C indicating that a substitute quarterback is in the game, thereby distinguishing the team's progress and the substitute quarterback's rushing and passing efforts from the starting quarterback. If and when the starting quarterback returns to the game, another ring can be placed on the last peg on RUSH row B or PASS row C in which the substitute quarterback was in the game.

The particular combinations of statistics in each of rows F, G and H are made with statistics which are unlikely to both occur on a single play. On rare instances when two statistics in a line are to be recorded for a single play, a priority schedule can be established such as the following:

Row F, an opponent runback peg or empty peghole (no runback) has priority over a point after touchdown attempt peg;

Row G, a kickoff peg has priority over a fumble peg; and

Row H, an opponent runback peg or empty peghole (no runback) has priority over a penalty peg.

The rings can also be varied either in color or in material, e.g., metal rings and rubber rings can be used for different purposes. Thus, black or rubber rings could be used for ordinary recording and a metal ring could be used when it is desired to record a running or passing play from a particular formation, to distinguish a two point after touchdown attempt by rushing from one attempted by passing, to record fumbles which nullified scores, etc.

Finally, a permanent record of each recorded period of the game can be kept simply by taking a color photograph of the board before the pegs are removed and the board readied for commencement of a new period of recording, such as the second half.

The invention has been described with reference to the presently preferred embodiments thereof. It is not intended that the invention be unduly limited by this disclosure. Instead, it is intended that the invention be defined by the method steps, and their obvious equivalents set forth in the following claims.

What is claimed is:

1. A recording device useful for calculating and recording play statistics during a football game which comprises:

a body bearing at least two longitudinal grooves;

a slide movably carried on said body and in at least one of said grooves;

a scale calibrated in indicia of arithmetic progression coextensive with said slide;

removable marker means, each bearing an indicum of a single class of a plurality of distinct classes of indicia identifying said marker as pass complete, pass incomplete, pass intercepted, and rushing play; and first and second sets of first, second, and third parallel rows of a plurality on receiver means on said body one set each associated with one of said grooves and associated therewith, indica identifying one each of said rows with a respective indicum of passing, rushing, and first down statistics, said plurality of receiver means being located in equal arithmetic spacing to the spacing of said indicia on said slide forming a plurality of aligned lateral columns of receiver means, one column for each of the plays by the team in possession during the recording interval of a football game and receiving said removable marker means to record passing, rushing, and first down statistical information.

2. The recording device of claim 1 wherein said body also bears receiver row means in said groove with each receiver means thereof located in a respective column of said aligned vertical columns to receive marker means to register the end or start of a drive.

3. The recording device of claim 2 wherein said receiver row means in said groove comprise a plurality of receiver means, one each in each of said columns, and the empty receiver means thereby permitting a rapid determination of the number of plays in each drive.

4. The recording device of claim 2 wherein said marker means positioned in said receiver row means of said groove obstruct movement of said slide and thereby provide reference stop means for said slide.

5. The recording device of claim 2 wherein said receiver row means comprises two rows of receiver means, each with respective indicum for end of drive by rushing or passing or by kicking.

6. The recording device of claim 5 wherein said body also bears receiver row means in said groove to receive start of drive marker means.

7. The recording device of claim 2 wherein each of said marker means received in said receiver row means bears one of an indicia identifying end of drive by a rushing or a passing play.

8. The recording device of claim 1 wherein each of said marker means bears one of an indicia identifying a play of pass interception, completion, incompletion, run, scramble or sack.

9. The recording device of claim 1 wherein plurality of classes of marker means are employed bearing class-characteristic distinguishing indicia.

10. The recording device of claim 9 wherein said distinguishing indicia are colors.

11. The recording device of claim 1 wherein said marker means are pegs and said receiver means are apertures in said rule body.

12. The recording device of claim 10 including supplemental marker means cooperative with said first marker means.

13. The recording device of claim 12 wherein said marker means are pegs and said supplemental marker means are rings for placement over said pegs.

14. The calculating device of claim 12 wherein said supplemental marker means are used to record ending and starting yardlines of drives.

15. The calculating device of claim 12 wherein said supplemental marker means are used to record successful third of fourth down conversions for a first down.

16. The calculating device of claim 1 wherein said body bears two grooves to receive interchangeable slide means and bears duplicate sets of receiver means, one set thereof for each of the teams in a football game.

17. The recording device of claim 1 wherein said body bears a row of receiver means with indicia for opponent runback and point after touchdown attempt statistics.

18. The recording device of claim 17 wherein said row or receiver means with indicia for opponent runback and point after touchdown attempt statistics has one each of receiver means in said aligned columns whereby empty receiver means can signify absence of a runback on any particular play.

19. The recording device of claim 1 wherein said body bears a row of receiver means with indicia for kickoff and fumble statistics.

20. The recording device of claim 1 wherein said body bears indicia spaced at regular intervals along said receiver means indicating the number of first downs for its respective interval which reflects game control by the offensive team.

21. The recording device of claim 20 wherein said indicia also indicates the number of first downs for each respective interval which reflect game control by the defensive teams.

22. The recording device of claim 1 wherein said body bears a row of receiver means with each receiver means thereof located in a respective column of said aligned lateral columns of receiver means with indicia for penalties.

23. The recording device of claim 1 wherein said plurality of distinct classes of indicia also includes the classes of: quarterback scramble, quarterback sack, and quarterback keeper.

24. The recording device of claim 1 wherein said plurality of distinct classes of indicia also includes classes of: third down conversion attempt missed, third down conversion attempt made, fourth down conversion attempt missed, and fourth down conversion attempt made.

25. The recording device of claim 2 wherein said plurality of distinct classes also includes classes of drive start indicia identifying the approximate starting yardline for each drive, and classes of drive end by interception or fumble, drive end by fourth down conversion attempt missed, and drive end by defensive score.

* * * * *